US005522753A

United States Patent [19]

McGraw

[11] Patent Number: 5,522,753

[45] Date of Patent: Jun. 4, 1996

[54] FLYING DEVICE HAVING STAGGERED PARALLEL AIRFOILS

[76] Inventor: James E. McGraw, 1617 Linden St., East Lansing, Mich. 48823

[21] Appl. No.: 444,254

[22] Filed: May 19, 1995

Related U.S. Application Data

[63] Continuation of Ser. No. 186,108, Jan. 25, 1994, Pat. No. 5,417,602.

[51] Int. Cl.[6] ..... A63H 27/00

[52] U.S. Cl. ..... 446/36; 446/34; 446/46; 446/48; 273/425

[58] Field of Search ..... 446/36, 34, 46–48, 446/61, 66; 273/424, 425; D21/82, 85, 86, 89; 24/67.9; 132/231, 276–279; 267/158, 164, 165

[56] References Cited

U.S. PATENT DOCUMENTS

| | | | |
|---|---|---|---|
| D. 144,218 | 3/1946 | Roberts | D28/42 |
| D. 185,529 | 6/1959 | Caldora | D28/40 |
| 1,806,148 | 5/1931 | Dahl . | |
| 2,277,853 | 3/1942 | Kohn | 267/80 |
| 2,358,438 | 9/1944 | Beachley | 267/109 |
| 3,898,717 | 8/1975 | Shwartz | 132/277 |
| 4,143,483 | 3/1979 | Kifferstein et al. | 446/47 |
| 4,216,611 | 8/1980 | Psyras | 273/424 |
| 4,955,620 | 9/1990 | Reinke . | |
| 5,030,157 | 7/1991 | Silverglate . | |
| 5,066,258 | 11/1991 | Tomberlin . | |
| 5,078,637 | 1/1992 | McFarland | 273/424 |
| 5,080,624 | 1/1992 | Brinker | 446/36 |
| 5,269,716 | 12/1993 | Viola | 446/36 |

FOREIGN PATENT DOCUMENTS

| | | | |
|---|---|---|---|
| 649428 | 9/1962 | Canada | 446/36 |
| 608859 | 8/1926 | France | 132/278 |
| 960233 | 10/1949 | France | 24/67.9 |
| 3797 | 4/1901 | Germany | 132/278 |
| 422850 | 12/1925 | Germany | 273/425 |

*Primary Examiner*—Mickey Yu
*Assistant Examiner*—Jeffrey D. Carlson
*Attorney, Agent, or Firm*—Ian C. McLeod

[57] ABSTRACT

A flying toy (10) having an airfoil member (12), is described. The airfoil member includes opposed ends (16) with slats (14) extending therebetween. The opposed ends are connected to an annular outer ring (22) comprised of hollow tubing (24). The slats have first and second ends (14A and 14B) which are mounted to the opposed ends of the airfoil member 12. The center portion (14C) of the slats 14 are arced either above or below the plane A formed by the opposed ends of the airfoil member. The arced slats allow air to flow through and over the airfoil member 12 of the toy which enables the toy to fly straight and to stay in flight for a longer distance. The airfoil member is also able to be used without the annular ring to form an alternate embodiment of the toy 100.

3 Claims, 2 Drawing Sheets

FLYING DEVICE HAVING STAGGERED PARALLEL AIRFOILS

This is a continuation of application Ser. No. 08/186,108, now U.S. Pat. No. 5,417,602, filed Jan. 25, 1994.

BACKGROUND OF THE INVENTION

1. Field of the Invention

The present invention relates to a flying device which rotates during flight. In particular, the present invention relates to a flying toy having an airfoil member which enables the toy to stay elevated for a longer duration and which increases the stability of the toy to allow for straighter and longer distance flight.

2. Prior Art

The prior art has described various types of rotating flying toys. Illustrative of the prior art flying toys are U.S. Pat. No. 4,955,620 to Reinke; U.S. Pat. No. 5,030,157 to Silverglate; U.S. Pat. No. 5,066,258 to Tomberlin and U.S. Pat. No. 5,080,624 to Brinker.

Reinke describes an aerial projection having a generally frusto-conical, solid body of symmetrical configuration. The projection is intended to simulate the curved flight of a ball without relying on the skill of the pitcher. The projectional is useful in batting and throwing games.

Silverglate describes a bladed flying toy having a central hub with a plurality of elongated support arms extending radially outwardly. An annular ring with a diameter greater than the hub is deposed coaxially with the hub and is attached to the outer ends of the support arms. A plurality of blades are attached to the support arms by flexible hinge means which allow the blades to rotate in response to the direction of airflow.

Tomberlin describes a flying toy which returns to the thrower. The toy has first and second rotary elements which are held together in a spaced relationship by a hub. A length of flexible line is connected to the hub and wound thereon prior to use. Each rotary element contains a plurality of members which extend outward from the axis of rotation. Each rotary element also contains an edge guard extending between and connected to the outer ends of the members. During use, the members are intended to provide lift to the device as the device is rotated. The flexible line returns the toy to the user by rewinding around the hub for the return flight.

Brinker describes a flying disc toy having a first and second counter-rotating spinners orthogonally disposed upon a centered vertical axle. The spinners have a central hub and a rigid outer circular rim which is in coplanar alignment with the hub. A plurality of uniformly spaced elongated fins extend between the hub and the rim. The spinners rotate in opposed directions which gives the disc lift during flight.

Also of interest is U.S. Pat. No. 1,806,148 to Dahl which describes a safety wing for an aircraft.

None of the above prior art patents describe a flying toy having airfoils which enables the toy to fly straighter for a longer distance.

OBJECTS

It is therefore an object of the present invention to provide a flying device which will fly for a longer duration and distance. Further, it is an object of the present invention to provide a flying device having airfoils which stabilize the device to provide straighter flight. Still further, it is an object of the present invention to provide a flying device which is easy to throw and easy to catch. Further, it is an object of the present invention to provide a device which rotates during flight and creates an interesting pattern visible by the user. Finally, it is an object of the present invention to provide a device which is safe for children to play with and which is easy and inexpensive to manufacture.

DETAILED DESCRIPTION OF THE PREFERRED EMBODIMENTS

The present invention relates to a device for flying in air, which comprises: support means providing spaced apart ends of the device in a plane and an opening between the spaced apart ends; and parallel airfoil means having spaced apart ends connected to the support means, and with a center portion between the ends of the airfoil means extending above and below the plane of the support means which cause the device to fly when thrown into the air with the plane in a direction of movement of the device.

Further, the present invention relates to a device for flying in air, which comprises: support means providing spaced apart ends of the device in a plane and an opening between the spaced apart ends; and a plurality of side-by-side parallel slats having spaced apart ends connected to the support means and an arced center portion between the ends of the slats extending above and below the plane of the support means which cause the device to fly when thrown into the air with the plane in a direction of movement of the device.

Still further, the present invention relates to a method for making a device fly in air, which comprises: providing the device for flying in air, which comprises: support means providing spaced apart ends of the device in a plane and an opening between the spaced apart ends; and parallel airfoil means having spaced apart ends connected to the support means, and with a center portion between the ends of the airfoil means extending above and below the plane of the support means which cause the device to fly when thrown into the air with the plane in a direction of movement of the device; and grasping the support means and throwing the device in the air with the plane in the direction of movement of the device and with a snap of the wrist to impart rotational motion to the device.

Unexpectedly, the airfoil and the annular ring enable the device to stay airborne longer and also increase the stability of the device to create a straighter flight path.

The device can be used as a toy. It can also be used as a weapon or as a target. Other uses will be apparent to those skilled in the art.

Figure 1:
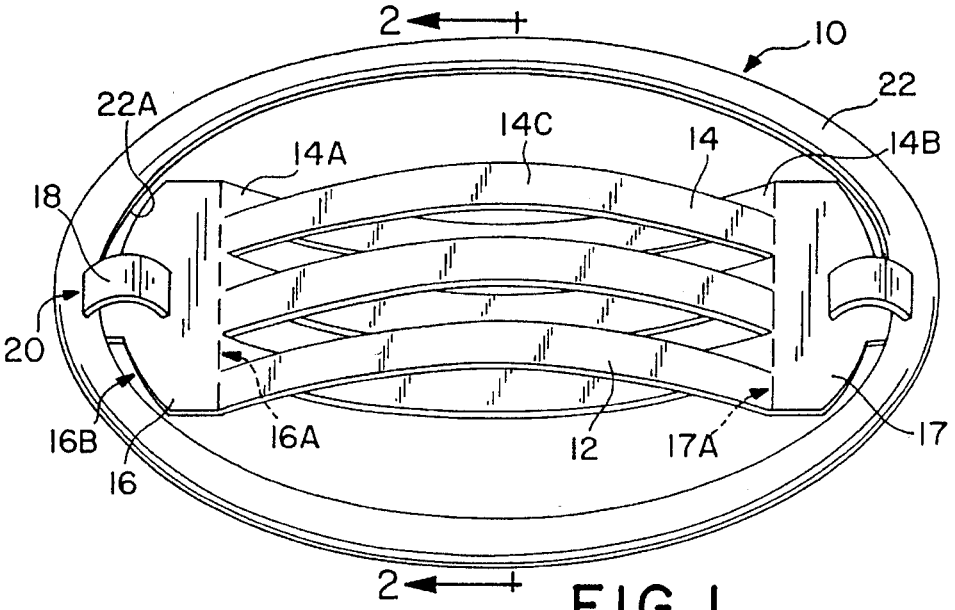
FIG. 1 is a perspective view of the flying toy 10 of the present invention showing the connector straps 18 for connecting the airfoil member 12 to the annular outer ring 22.
Figure 2:
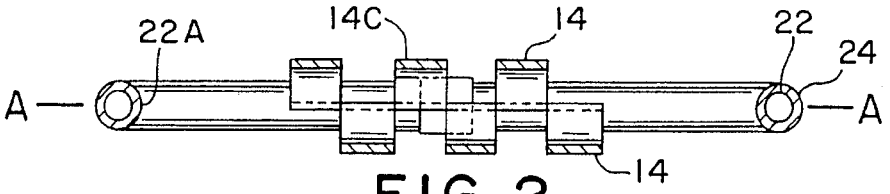
FIG. 2 is a cross-sectional view of FIG. 1 along the line 2—2 showing the arcing of the slats 14 and the hollow tubing 24 of the outer ring 22.
Figure 3:
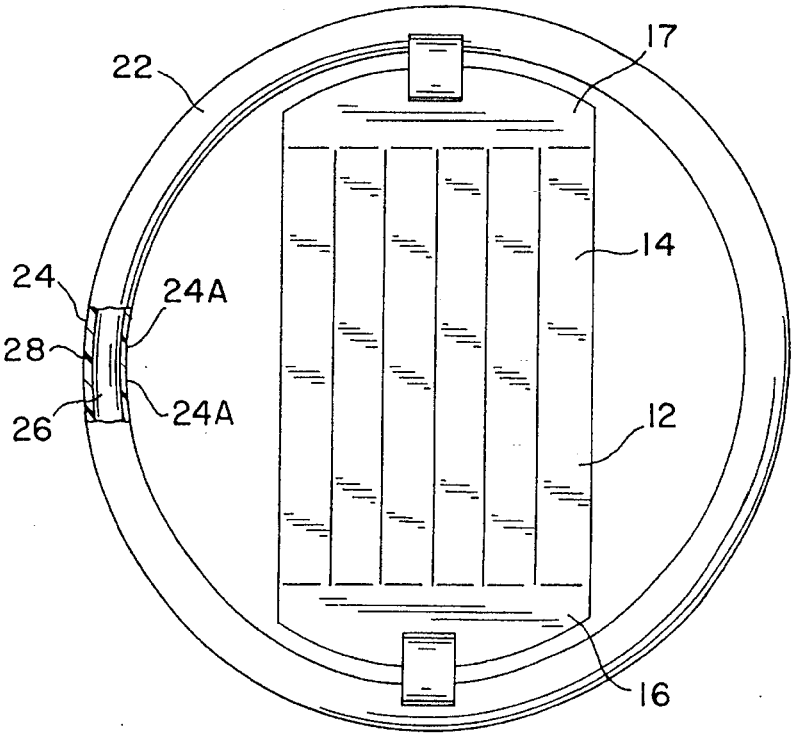
FIG. 3 is a top view of the flying toy 10 showing the slats 14 and the opposed ends 16 of the airfoil member 12.

FIGS. 1 to 3 show the preferred flying toy 10 of the present invention. The flying toy 10 is composed of an airfoil central member 12 and an annular outer ring 22. The airfoil central member 12 of the flying toy 10 has slats 14 extending between opposed ends 16 and 17 of the member 12. The opposed ends 16 and 17 of the member 12 are spaced apart in a parallel relationship such as to form the plane A. The ends 16 and 17 are preferably identical and therefore only one end 16 will be described in detail. The end 16 preferably has an essentially rectangular shape with an inner side 16A and an outer side 16B. The end 16 is positioned such that the inner side 16A is adjacent the slats 14 and the outer side 16B is adjacent the outer ring 22 (to be described in detail hereinafter). The outer side 16B preferably has an arcuate shape similar to the shape of the inner curved surface 22A of the ring 22. The arcuate outer side 16B of the end 16 is provided with a connector strap 18 which extends outward from the outer side 16B towards the annular ring 22 and acts to connect the annular ring 22 to the airfoil member 12 (FIG. 1). The connector strap 18 can also be a separate, independent strap (not shown) which mounts through the annular ring 22 and the airfoil member 12 and contains a locking mechanism (not shown) in order to securely mount the airfoil member 12 within the annular ring 12.

The slats 14 of the airfoil member 12 have a first end 14A and a second end 14B with an arced center portion 14C, therebetween. In the preferred embodiment, the slats 14 extend the length of the airfoil member 12 between the opposed ends 16 and 17. The slats 14 are positioned side-by-side and parallel to each other. Preferably, there is no space between the ends 14A or 14B of the slats 14 mounted on the inner side 16A of the opposed ends 16 and 17 of the airfoil member 12. In the preferred embodiment, the airfoil member 12 contains six (6) slats 14. It is understood, however, that the airfoil member 12 can have any number of slats 14 provided the airfoil member 12 is still able to fly. The slats 14 are preferably identical in shape and size and are mounted similarly, such that, only one need be described in detail. The slat 14 is mounted between the opposed ends 16 and 17 of the airfoil member 12 such that the first end 14A of the slat 14 is connected to the inner side 16A of one opposed end 16 and the second end 14B of the slat 14 is connected to the inner side 17A of the other opposed end 17 of the airfoil member 12. The slat 14 is mounted such that the arced central portion 14C is above or below the plane A formed by the opposed ends 16 and 17 of the airfoil member 12. As shown in FIG. 2, the slats 14 are arced such that the slats 14 alternately extend above and below the plane A of the opposed ends 16 and 17. The slats 14 preferably are identical and have the same arc such that the central portion 14C of each slat 14 extends above or below the plane A the same distance (FIG. 2). In the preferred embodiment, the furthest distance of the slat 14 above or below the plane A is at the middle of the central portion 14C of the slat 14.

Preferably, the opposed ends 16 and 17 including the connector strap 18, and the slats 14 of the airfoil member 12 are formed from a unitary piece. The slats 14 are formed between the two opposed ends 16 and 17 by slicing the airfoil member 12 longitudinally between the opposed ends 16 and 17. The opposed ends 16 and 17 are then moved together in order to enable the slats 14 to arc either above or below the plane A of the opposed ends 16 and 17. The user determines the direction of arc of the slats 14 by physically arcing each slat 14 the first time the opposed ends 16 and 17 are moved together. Preferably, the airfoil member 12 is constructed from a flexible plastic which is easy to cut and to bend and which holds its shape once bent. The weight of the airfoil member 12 is dependent on the particular size of the overall toy 10. In an alternate embodiment (not shown), the airfoil member is constructed from an upper and lower plate which are connected together at the ends, the upper and lower plate can be constructed from a single piece which is folded in half. In this embodiment, the slats of the airfoil member are able to be positioned directly in line above and below each other. Thus, the upper and lower plates would be identical.

The annular outer ring 22 of the toy 10 has an inner curved surface 22A with an inner diameter slightly larger than the length of the airfoil member 12 such that the airfoil member 12 is able to fit completely within the circumference of the annular outer ring 22. Preferably, the airfoil member 12 is in the plane formed by the annular ring 22 although the toy 10 will fly with the airfoil member 12 above or below the plane of the annular ring 22. The ring 22 is preferably constructed from a flexible, hollow plastic tubing 24 such that the ends 24A of the straight single piece of tubing 24 are able to be bent around and attached together to form the ring 22. The tubing 24 is held together by an internal pin 26 which extends into the interior of both ends 24A of the tubing 24. The internal pin 26 is preferably of a length such that a young child is unable to swallow the internal pin 26 should the pin 26 come loose from the annular ring 22. The longer the internal pin 26, the more securing ability it provides for connecting the ends 24A of the tubing 24 together to form the annular ring 22. Preferably, an adhesive (not shown) is applied to the pin 26 in order to fasten the ends 24A of the tubing 24 together and to securely hold the internal pin 26 within the tubing 24. The outer ring 22 is provided with a pair of apertures 20 spaced 180° apart around the ring 22. The connector straps 18 extending from the opposed ends 16 and 17 of the airfoil member 12 extend through the apertures 20 and are wrapped around to be secured in an opening (not shown) in the opposed ends 16 and 17, respectively, of the airfoil member 12. The straps 18 extend through the opening and are prevented from slipping out of the opening by crimping the end of the straps 18. The connection point 28 of the tubing 24 is preferably located on one side of the ring 22 spaced apart from the connections of the airfoil member 12 to the ring 22 approximately 90°. The tubing 24 preferably has an outer diameter of about 1–2 cms such that the ring 22 is able to be easily grasped by the user. The ring 22 is also preferably constructed of a soft, smooth plastic such as to reduce the possible harm caused to a user or participant if hit by the flying toy 10. In general, the weight of the toy 10 is less than the weight of a Frisbee® having a similar diameter.

Figure 4:
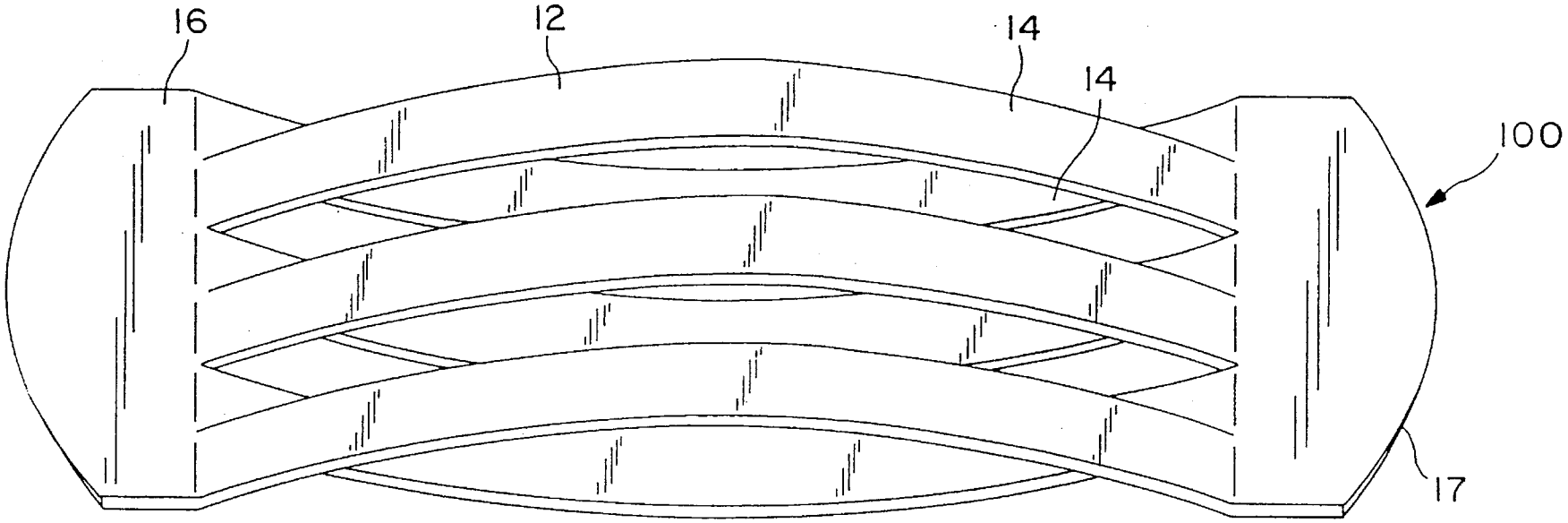
FIG. 4 is a perspective view of the alternate embodiment of the flying toy 100 showing the airfoil member 12 without the outer ring 22.

As shown in FIG. 4, the airfoil member 12 is also able to be used as a flying toy 100 alone without the outer ring 22. The toy 100 also has the ability to fly for a longer duration and has a straight flight pattern.

As an alternate method (not shown) for connecting the airfoil member to the outer ring, length of the airfoil member is increased such that the opposed ends of the airfoil member extend completely into the outer ring. Thus, the outer sides of the opposed ends are encased within the outer ring. An adhesive on the opposed ends ensures that the airfoil member remains in the annular ring. The airfoil member is also held in place due to the relative sizes of the airfoil member and the inner diameter of the ring. It is also possible to construct the entire toy with the ring member from a single unitary piece. In this instance, however, the annular ring is not hollow and thus may not be as soft and pliable as the preferred embodiment.

IN USE

To use the toy 10, the user grasps the outer annular ring 22 and tosses the toy 10 using a flick of the wrist to impart rotation on the toy 10. The toy 10 is tossed such that the direction of flight of the toy 10 is the same as the plane A of the opposed ends 16 and 17 of the airfoil member 12. If the toy 100 without the ring is used, the user grasps one of the opposed ends 16 of the airfoil member 12 and tosses the toy 100 in the same manner as described above. In either embodiment, the toy 10 or 100 is thrown with either side up as the toy 10 or 100 is preferably identical on both sides. Thus, unlike a Frisbee® the toy 10 or 100 will fly equally as well upside down. The arcing of the slats 14 of the airfoil member 12 allows air to pass through the airfoil member 12 thus, the air pushes the slats 14 outward from the plane A of the ring 22. The slats 14 extending above the plane A of the airfoil member 12 are pushed upward while the slats extending below the plane A are pushed downward. Preferably, the airfoil has an equal number of identical slats 14 above and below the plane A, thus the air exerts pressure upward and downward equally which could give the toy 10 the lift which adds distance and duration to the flight of the toy 10 in response to the same force. Alternately, the arcing of the slats 14 of the airfoil member 12 could create a wing-like effect which gives the toy 10 lift and adds to the distance of flight. It is uncertain as to exactly what aspect of the toy 10 causes the unexpected flight distances achieved by the toy 10. The following chart lists test flights which were conducted which show the unexpected distances achieved by the toy 10. The chart shows distances achieved by the toy 10 when the average adult user tossed the toy 10, with the plane A of the opposed ends 16 and 17 of the airfoil member 12 (a) parallel to the ground surface (not shown) (b) at an angle to the ground surface and (c) perpendicular to the ground surface at a level height, with an arcing height and straight up.

TEST CHART

| | HORIZONTAL FLIGHT (Ft) | | VERTICAL FLIGHT |
|---|---|---|---|
| Throws | Parallel at 5'6" | Angled | (Ft) Perpendicular |
| 1 | 93 | 75 | 80 |
| 2 | 75 | 105 | 75 |
| 3 | 60 | 111 | 90 |
| 4 | 90 | 129 | |
| 5 | 93 | | |
| 6 | 105 | | |
| 7 | 75 | | |
| 8 | 100 | | |
| AVERAGE | 86 | 105 | 82 |

In the angled flight, the toy 10 tended to go over the top of the arc so as to not arc back to the user, unlike a Frisbee® which arcs back when thrown at an angle by the user. In addition, straight upward, vertical throwing of the toy 10 produced much higher distances than those achieved by a similarly thrown Frisbee® of similar size. The air flowing through the slats 14 of the airfoil member 12 also seems to act to straighten the flight of the toy 10. Thus, the user is able to better direct the direction of flight of the toy 10 and the other participant is better able to catch the toy 10. Furthermore, the slats 14 of the airfoil member 12 or the annular outer ring 22 are able to be decorated or constructed with a variety of designs (not shown) which create interesting patterns during the flight of the toy 10.

It is intended that the foregoing description be only illustrative of the present invention and that the present invention be limited only by the hereinafter appended claims.

I claim:

1. A method for making a device fly in air, which comprises:

(a) providing the device for flying in air, consisting essentially of: a plurality of side-by-side parallel airfoils having spaced apart ends each with a center portion between the ends; and spaced apart support ends defining a plane and connected to the spaced apart ends of the airfoils, wherein at least one of the center portions of the airfoils extends entirely above the plane of the support ends and at least one of the center portions of the airfoils extends entirely below the plane of the support ends and wherein the device flies when thrown into the air with the plane in a direction of movement of the device; and (b) grasping the support ends and throwing the device in the air with the plane in the direction of movement of the device and with a snap of the wrist to impart rotational motion to the device.

2. The method of claim 1 wherein the device is thrown in a forward direction with the plane parallel to a ground surface.

3. The method of claim 1 wherein the device is thrown in a forward direction with the plane at an angle to a ground surface.

* * * * *